US008100391B2

(12) United States Patent
Terao et al.

(10) Patent No.: US 8,100,391 B2
(45) Date of Patent: Jan. 24, 2012

(54) SHEET POST-PROCESSING APPARATUS

(75) Inventors: Yasunobu Terao, Izunokuni (JP); Mikio Yamamoto, Izunokuni (JP); Sadayoshi Mochida, Numazu (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/872,321

(22) Filed: Aug. 31, 2010

(65) Prior Publication Data

US 2010/0320681 A1 Dec. 23, 2010

Related U.S. Application Data

(63) Continuation of application No. 11/616,453, filed on Dec. 27, 2006, now Pat. No. 7,798,481.

(30) Foreign Application Priority Data

Dec. 29, 2005 (JP) ..... 2005-380565

(51) Int. Cl.
*B65H 37/04* (2006.01)

(52) U.S. Cl. ..... 270/58.13; 270/58.04; 270/58.08; 270/58.11; 270/58.28

(58) Field of Classification Search ..... 270/58.04, 270/58.08, 58.09, 58.11, 58.13, 58.19, 58.26, 270/58.28

See application file for complete search history.

(56) References Cited

U.S. PATENT DOCUMENTS

| | | | |
|---|---|---|---|
| 5,346,203 | A | 9/1994 | Stemmie |
| 5,971,394 | A | 10/1999 | Kida et al. |
| 6,145,826 | A | 11/2000 | Kawata |
| 6,644,643 | B2 | 11/2003 | Nonaka et al. |
| 2006/0049570 | A1 | 3/2006 | Kobayashi |
| 2007/0063413 | A1 | 3/2007 | Terao et al. |
| 2007/0065204 | A1 | 3/2007 | Terao et al. |
| 2007/0138729 | A1 | 6/2007 | Terao et al. |
| 2007/0145660 | A1 | 6/2007 | Terao et al. |

FOREIGN PATENT DOCUMENTS

JP 2004-155551 6/2004

OTHER PUBLICATIONS

U.S. Office Action dated Jun. 30, 2009 corresponding to U.S. Appl. No. 11/616,453.

U.S. Office Action dated Oct. 21, 2009 corresponding to U.S. Appl. No. 11/616,453.

*Primary Examiner* — Leslie A Nicholson, III

(74) *Attorney, Agent, or Firm* — Turocy & Watson, LLP

(57) ABSTRACT

A sheet post-processing apparatus of the present invention comprises: a sheet discharge section that feeds a sheet supplied from an image forming apparatus to a post-processing section and leads the sheet that has passed through the post-processing section to a sheet discharge port; a sheet discharge tray that receives a sheet discharged from the sheet discharge port and can move to a first standby position and a second standby position higher than the first standby position and nearer to the sheet discharge port; and a controller that controls the height position of the sheet discharge tray by identifying the type of the sheet. The controller changes the height position of the sheet discharge tray to allow the sheet discharge tray to receive the discharged sheet at the first standby position in the case where the sheet is a first type while to receive the discharged sheet at the second standby position in the case where the sheet is a second type.

10 Claims, 13 Drawing Sheets

SHEET POST-PROCESSING APPARATUS

CROSS-REFERENCE TO RELATED APPLICATIONS

This application is a Continuation of application Ser. No. 11/616,453 filed on Dec. 27, 2006, the entire contents of which are incorporated herein by reference.

This application is based upon and claims the benefit of priority from prior Japanese Patent Application No. 2005-380565 filed on Dec. 29, 2005, the entire contents of which are incorporated herein by reference.

BACKGROUND OF THE INVENTION

1. Field of the Invention

The present invention relates to a sheet post-processing apparatus and a sheet post-processing method that perform post-processing for a sheet discharged from an image forming apparatus such as a copier, a printer, or a composite device.

2. Description of the Related Art

In recent years, there is developed a sheet post-processing apparatus which is disposed adjacent to the sheet discharge section of an image forming apparatus main body for the purpose of performing post-processing, such as sorting and stapling, for a sheet on which an image has been formed in the image forming apparatus. For example, in a post-processing apparatus that performs stapling processing, a plurality of sheets (sheet bundle) are aligned by an alignment means and stapled and, after that, fed to a sheet discharge tray to sequentially be loaded thereonto.

Such a sheet post-processing apparatus performs post-processing for a succeeding sheet after completion of the post-processing for a preceding sheet. Although the stapled sheet bundle is discharged onto the sheet discharge tray, the sheet alignment performance may deteriorate or the sheet may be folded at the time of discharge in some cases depending on the size, quality, stiffness or thickness of the sheet to be processed.

Jpn. Pat. Appln. Laid-open Publication No. 2004-155551 discloses a sheet discharge apparatus. The sheet discharge apparatus in this disclosure is featured in the configuration of a sheet discharge table, in which ingenuity has been applied thereto to prevent the discharged sheets from being disturbed. However, this disclosure does not cope with the deterioration of the sheet alignment performance due to a difference in the sheet type.

An object of the present invention is to provide a sheet post-processing apparatus and a sheet-post processing method capable of preventing the sheets discharged onto a sheet discharge tray from being disturbed to thereby enhancing the sheet alignment performance.

DETAILED DESCRIPTION OF THE PREFERRED EMBODIMENTS

Figure 1:
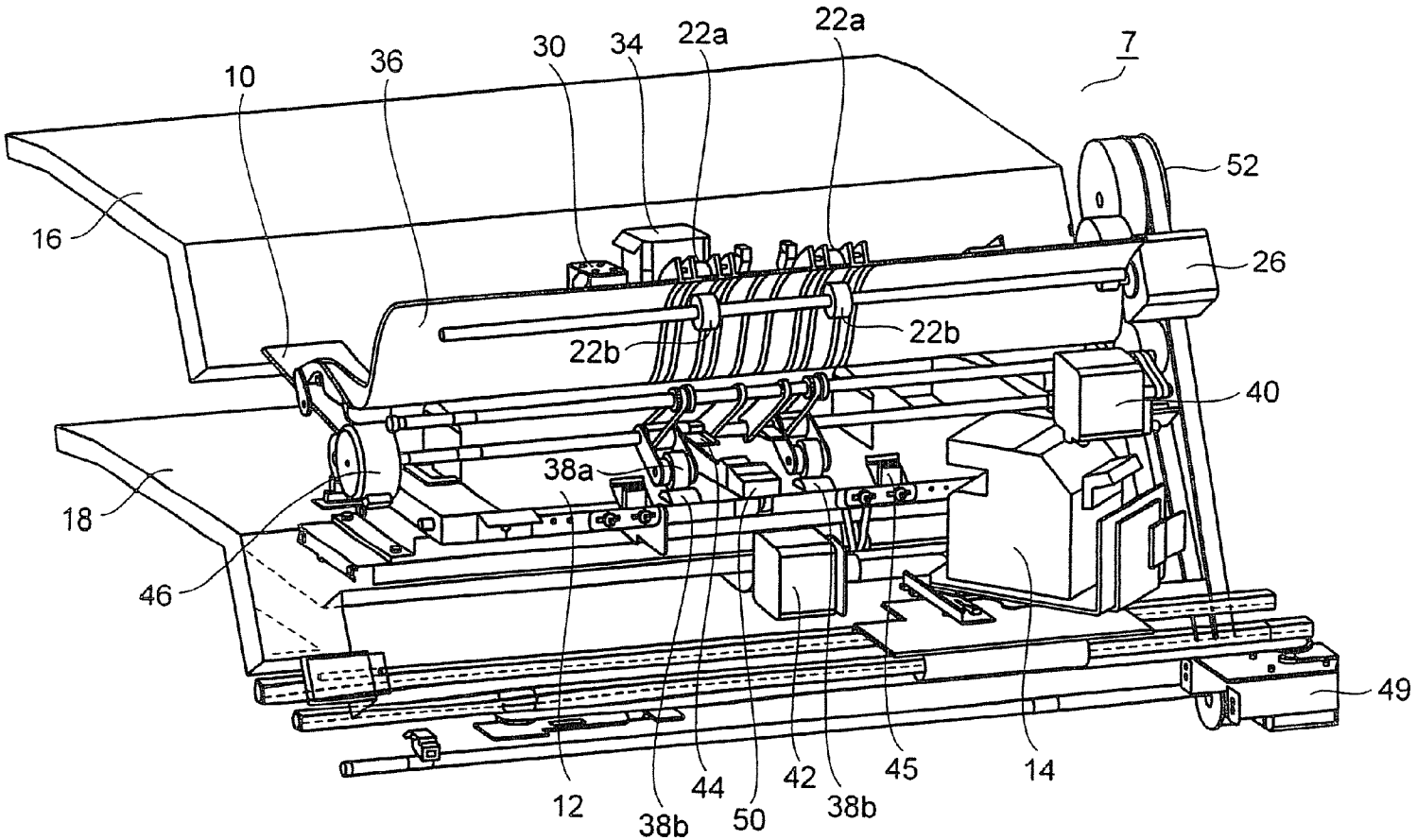
FIG. 1 is a perspective view showing a sheet post-processing apparatus according to an embodiment of the present invention.

Throughout this description, the embodiments and examples shown should be considered as exemplars, rather than limitations on the apparatus of the present invention.

Hereinafter, an embodiment of the present invention will be described in detail. In the following description, the same reference numerals denote the same parts through the drawings, and the overlapped description is omitted.

Figure 2:
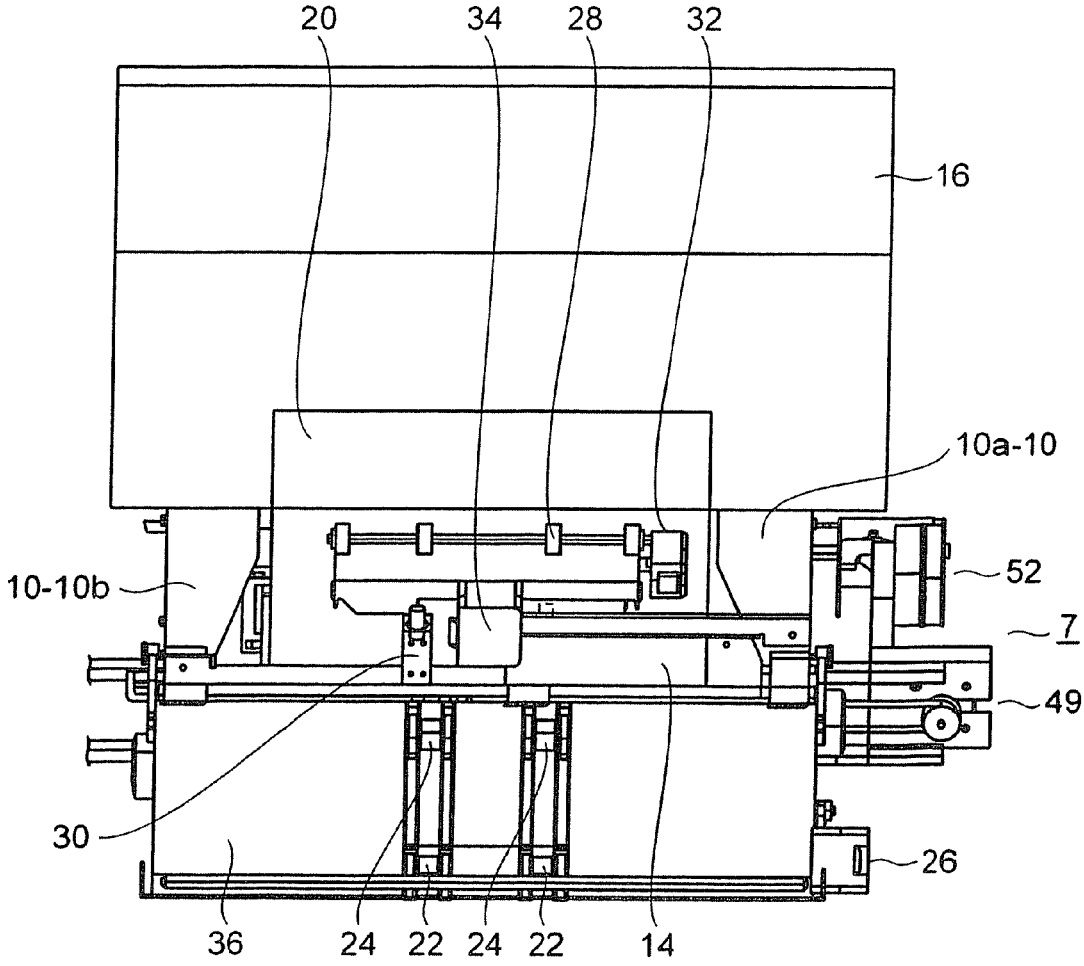
FIG. 2 is a top view of the sheet post-processing apparatus according to the embodiment of the present invention.
Figure 3:
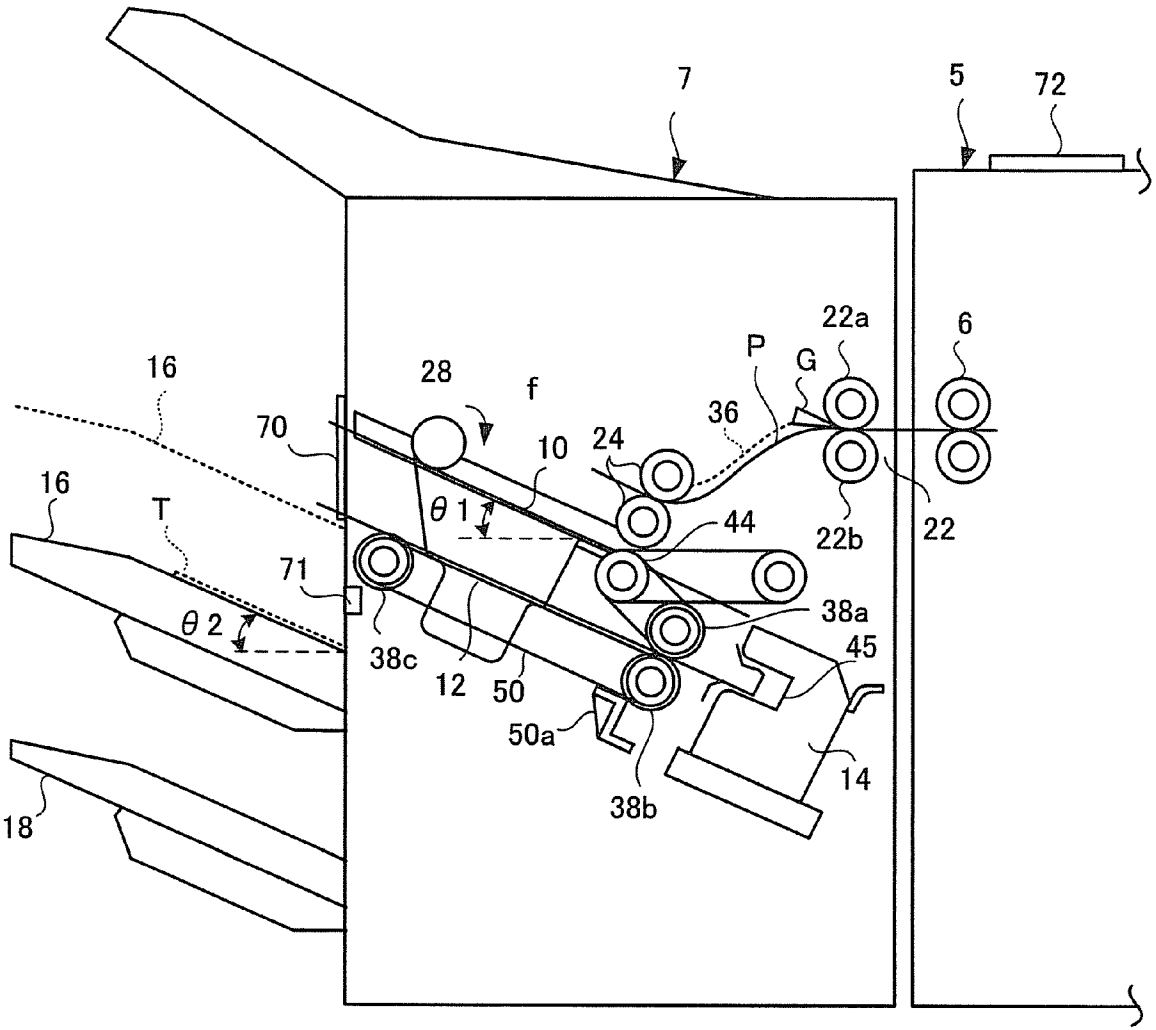
FIG. 3 is a view schematically showing a configuration of the sheet post-processing apparatus according to the embodiment of the present invention.

FIG. 1 is a perspective view showing the main part of a sheet post-processing apparatus according to an embodiment of the present invention. FIG. 2 is a top view of the main part of the sheet post-processing apparatus according to the embodiment of the present invention. FIG. 3 is a view schematically showing a configuration of the sheet post-processing apparatus according to the embodiment of the present invention. FIGS. 4 to 9 are views each showing a configuration of each component of the sheet post-processing apparatus.

Concrete configurations and operations of respective components shown in FIGS. 1 and 2 will be described using FIG. 4 and subsequent drawings afterward. Firstly, processing for a sheet in the sheet post-processing apparatus will be described using mainly FIG. 3.

A sheet P on which an image has been formed in an image forming apparatus 5 such as copier is fed by a pair of sheet discharge rollers 6 to a sheet post-processing apparatus 7. As shown in FIG. 3, the sheet post-processing apparatus 7 has a standby tray 10, a processing tray 12, a stapler 14, a sheet discharge trays 16 and 18, a gate G, and the like.

The sheet P fed by the pair of sheet discharge rollers 6 of the image forming apparatus 5 is received by a pair of entrance rollers 22 provided near the entrance of the sheet post-processing apparatus 7. The entrance rollers 22 have an upper roller 22*a* and lower roller 22*b* and are driven by a motor 26 (refer to FIG. 1).

A gate G for dividing the feeding path of the received sheet P into two feeding paths is provided on the downstream side of the entrance rollers 22. The gate G has a wedge-shaped cross section and its sharpened end is directed to the entrance rollers 22 side. The gate G is pivotably fitted to the side wall portion of the sheet post-processing apparatus 7, so that the sharpened end can be positioned at both first and second positions respectively pointing the upper entrance roller 22*a* and lower entrance roller 22*b*. The first position is selected in the case where post-processing needs to be applied to the sheet P, while the second position is selected in the case where post-processing need not be applied to the sheet P.

When the gate G is positioned at the first position, the sheet P is fed by first sheet feed rollers 24 to the standby tray 10. Between the entrance rollers 22 and standby tray 10, a paper path ceiling 36 for leading the sheet P to the sheet feed rollers 24 is installed. The sheet feed rollers 24 have an upper sheet feed roller and lower sheet feed roller. The standby tray 10 temporarily receives and loads the sheet P until post-processing applied to a plurality of sheets P on the processing tray 12 has ended.

Under the standby tray 10, a processing tray 12 for loading the sheets P dropped and supplied from the standby tray 10 is arranged. The processing tray 12, while the sheets P are stapled by the stapler 14 which is a post-processing mechanism for performing post-processing, supports the loaded sheets P in an aligned state.

Figure 7:
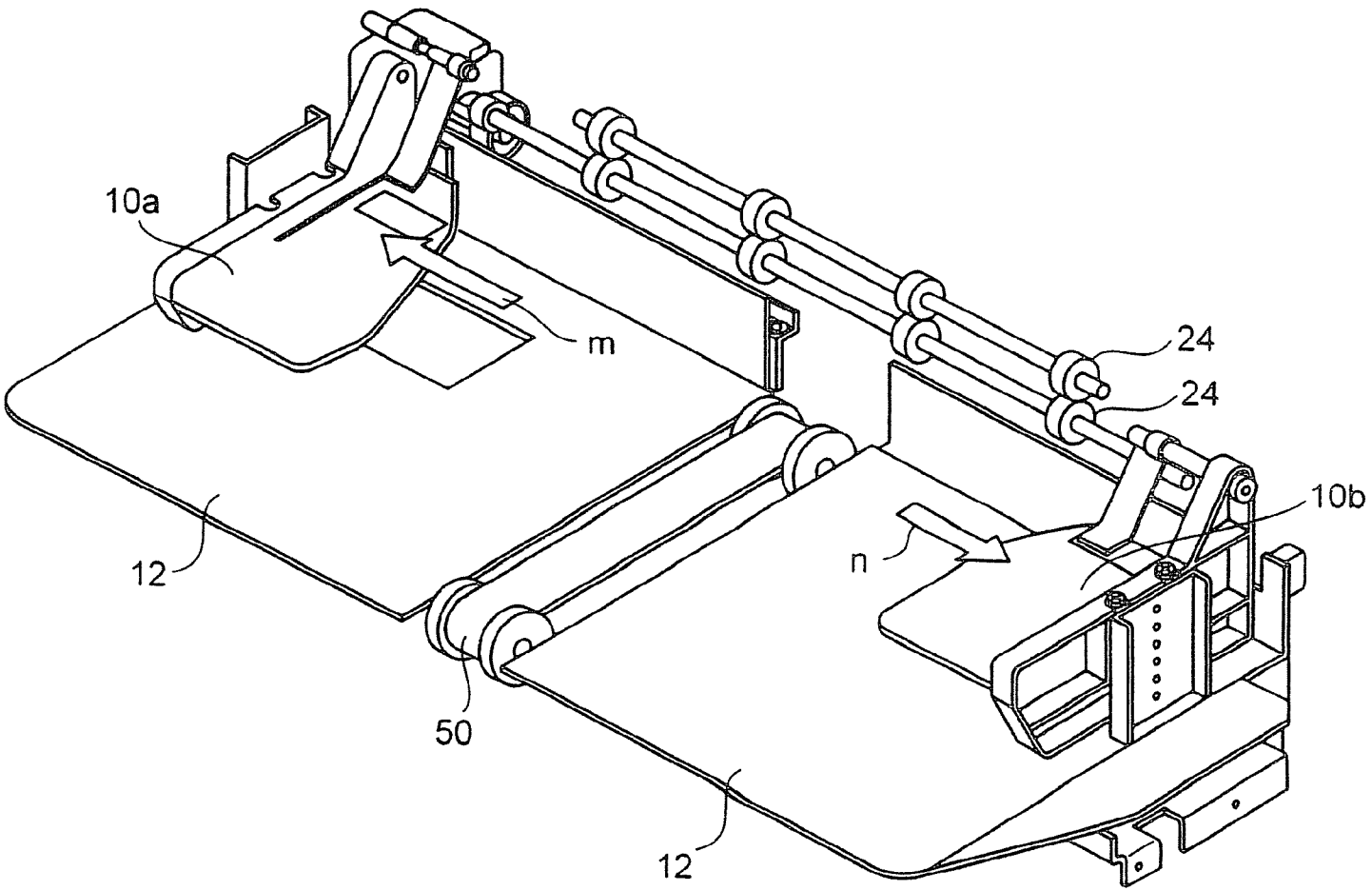
FIG. 7 is a perspective view schematically showing a standby tray and a processing tray of the sheet post-processing apparatus according to the embodiment of the present invention.

As shown in FIG. 7, when a predetermined number of sheets are stored on the standby tray 10, tray members 10*a* and 10*b* are opened in the directions of the arrow n and arrow m, respectively by a motor 34 (refer to FIG. 1). Then, the sheet P is dropped onto the processing tray 12 by its own weight and supplied to the stapler 14.

Figure 4:
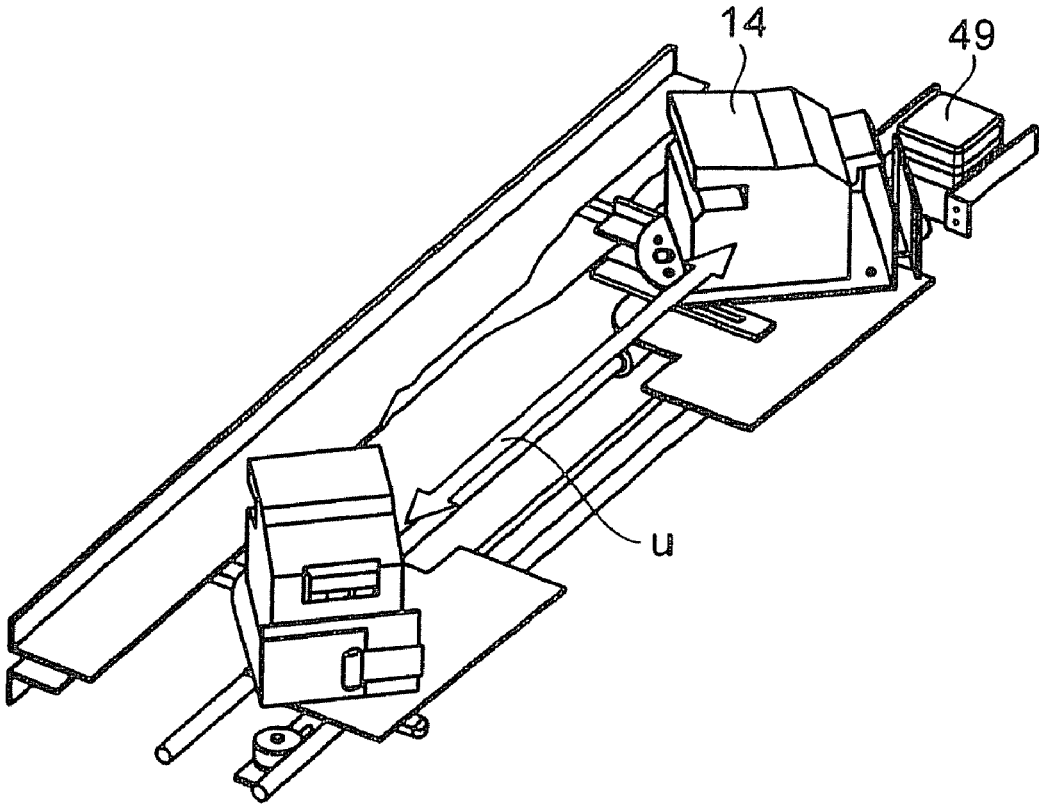
FIG. 4 is a perspective view showing a stapler of the sheet post-processing apparatus according to the embodiment of the present invention.
Figure 5:
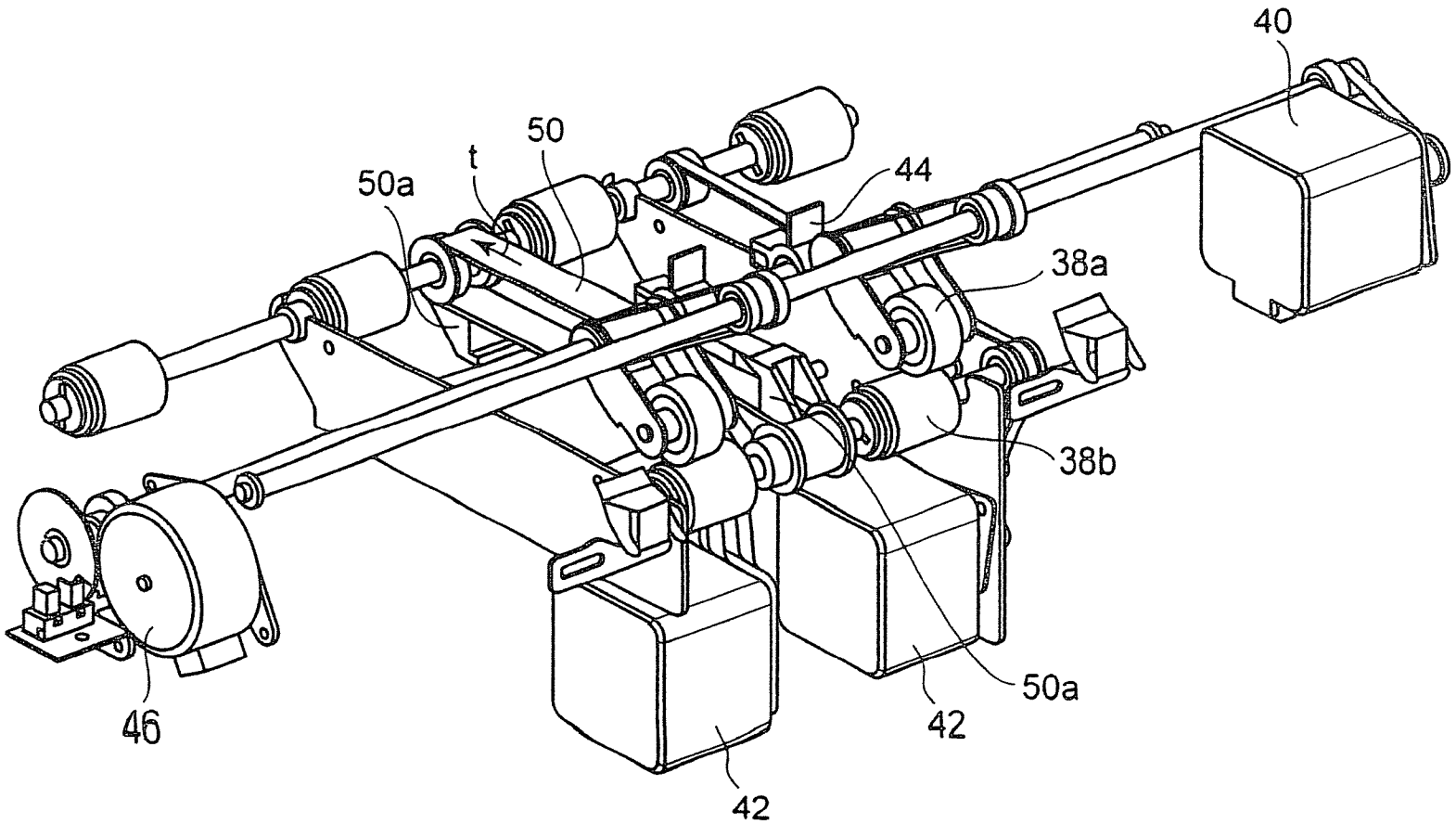
FIG. 5 is a perspective view showing vertical alignment rollers of the sheet post-processing apparatus according to the embodiment of the present invention.

As shown in FIG. 4, the stapler 14 is slid and positioned by a staple drive section 49 in u direction for performing stapling processing. The sheet post-processing apparatus 7 has only one stapler 14, and FIG. 4 shows the states before and after the slide operation of the stapler 14. In order to align a plurality of sheets P dropped and supplied from the standby tray 10 in the vertical direction which is the sheet feeding direction, the processing tray 12 has a pair of upper and lower vertical alignment rollers 38*a* and 38*b*, as shown in FIGS. 5 and 6.

The vertical alignment rollers 38*a* and 38*b* serve also as bundle conveyer rollers that hold and take out stapled sheet bundle T from the stapler 14. The vertical alignment roller 38*a* is driven by a motor 40 and vertical alignment roller 38*b* is driven by a motor 42. At the position where the rear end of the sheet P which is dropped and supplied onto the processing tray 12 is dropped, a paddle 44 is arranged. The paddle 44, which is configured to be rotatable, aligns vertically the uppermost sheet P loaded on the processing tray 12.

Figure 6:
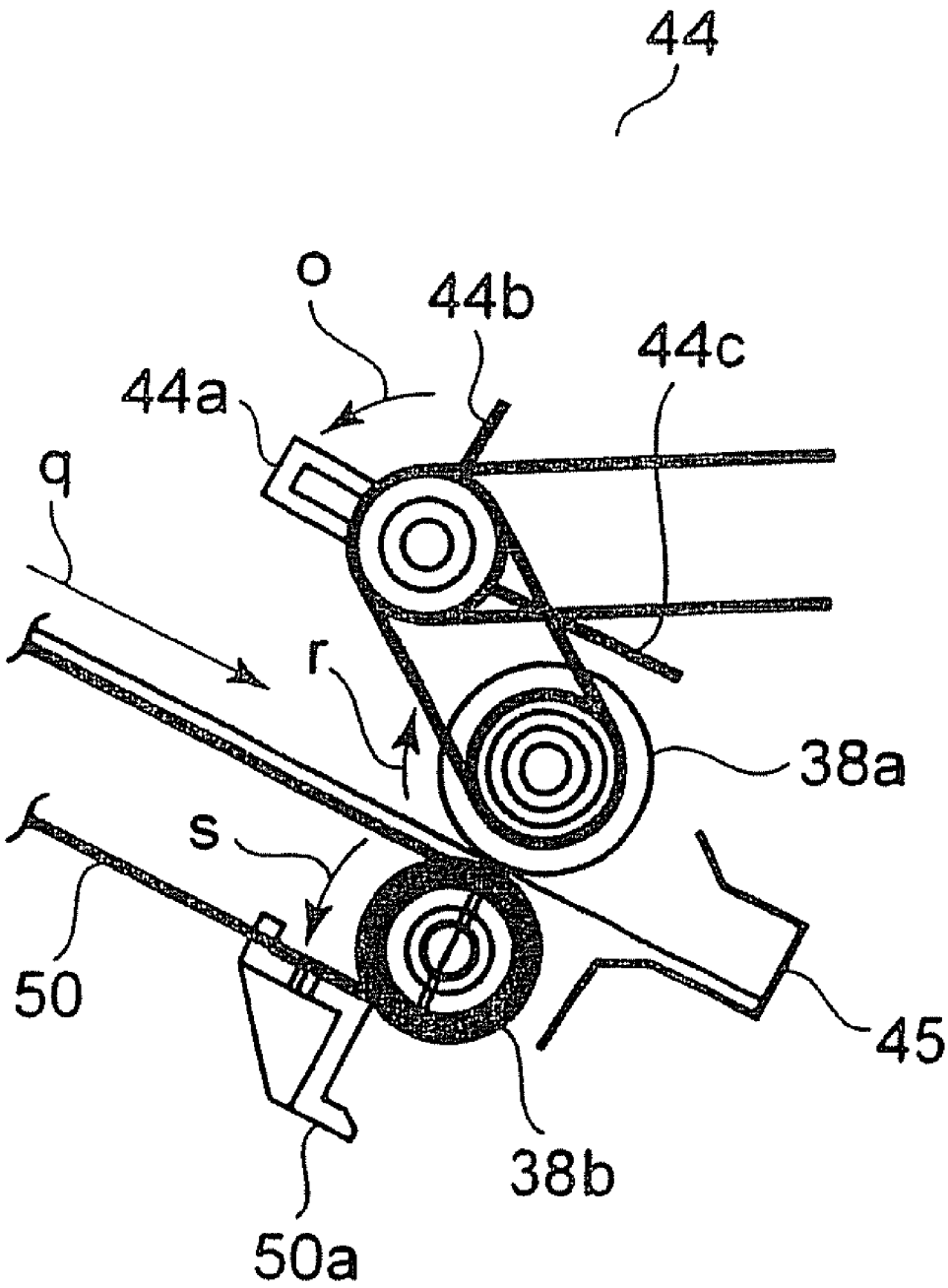
FIG. 6 is an explanatory view showing a paddle mechanism of the sheet post-processing apparatus according to the embodiment of the present invention.

The paddle 44, as shown in FIG. 6, has a receiving portion 44*a* which receives the rear end of the sheets P in the standby tray 10, a beating portion 44*b* for beating down the sheets P on the processing tray 12, and a feeding portion 44*c* for aligning the sheets P on the processing tray 12. The puddle 44 is driven by a motor 46 (refer to FIG. 5). The paddle 44 is composed of a rubber material and has elasticity.

At the end of the processing tray 12 on the side of the stapler 14, a stopper 45 that is brought into contact with the rear end of each of the sheets P and thereby restricts the rear end position is arranged. Almost at the center of the processing tray 12, a conveyor belt 50 is installed. The conveyer belt 50 feeds the sheet bundle T, which is stapled and taken out from the stapler 14 by the upper and lower vertical alignment rollers 38*a* and 38*b*, up to first or second sheet discharge tray 16 or 18. To the conveyer belt 50, a feed pawl 50*a* for hooking the rear end of the sheet bundle T is attached.

The standby tray 10 can drop and supply the sheet P onto the processing tray 12 and further can be used to feed the sheet P to the first or second sheet discharge tray 16 or 18. When the sheet P is to be fed to the sheet discharge tray 16 or 18, rotating rollers 28 for aligning the sheet P is brought into contact with the sheet P on the standby tray 10. The rotating rollers 28 are controlled by a standby tray roller drive source 30 in terms of their vertical movement and rotated by a motor 32 (refer to FIG. 2).

As shown in FIG. 3, the standby tray 10, to support the sheets P in a state that the front ends of the sheets P are positioned higher than the rear ends thereof, is arranged in a tilt angle θ1. The first or second sheet discharge tray 16 or 18 is moved up and down by a sheet discharge drive section 52 and either of them is selected. The first or second sheet discharge tray 16 or 18 is moved up and down up to almost the same height as that of the standby tray 10 or the processing tray 12 when loading the sheets P to improve the consistency of the sheets P to be discharged. Further, the first or second sheet discharge tray 16 or 18, to support the sheets P in a state that the front ends of the sheets P are positioned higher than the rear ends thereof, is arranged in a tilt angle θ2.

Figure 8:
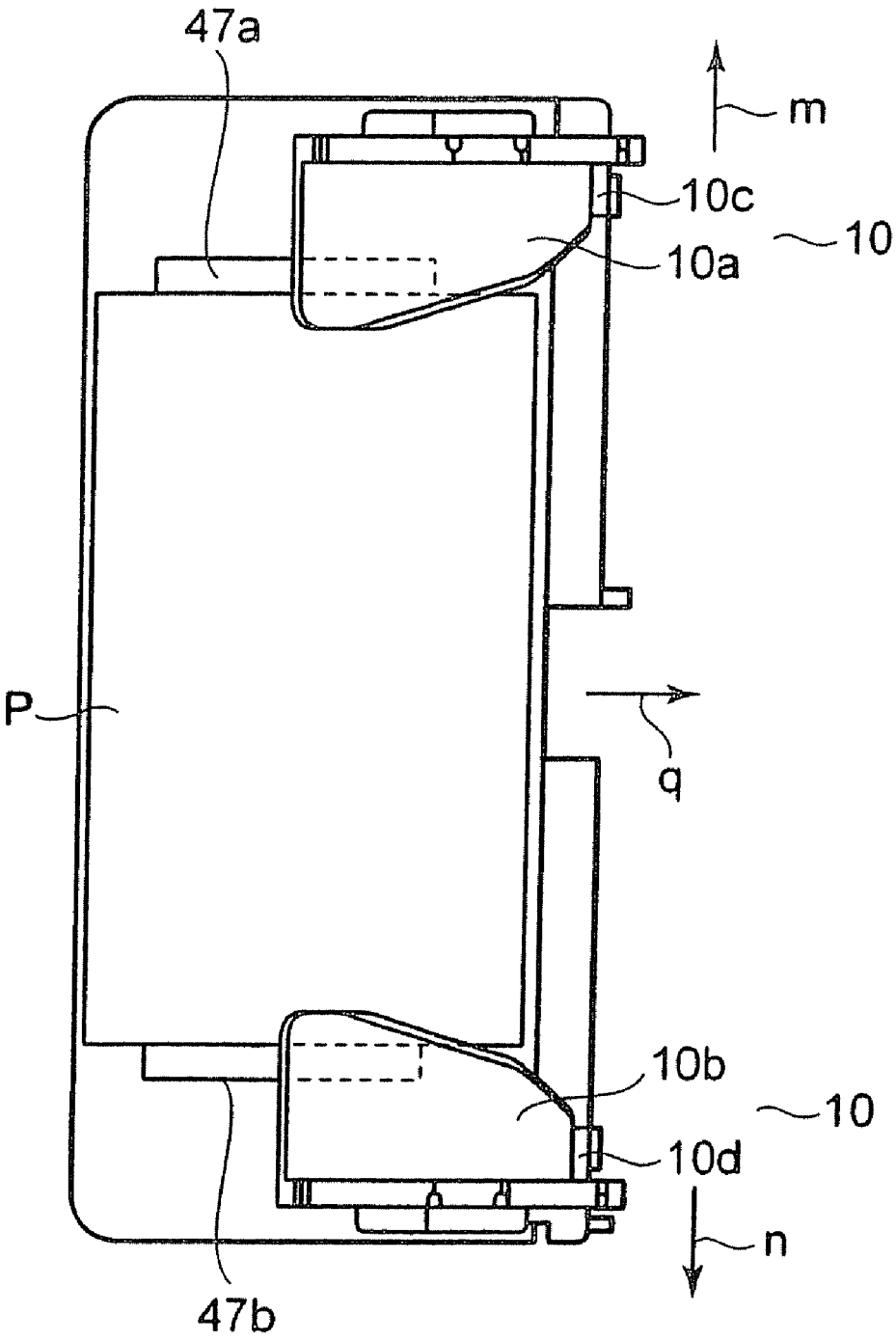
FIG. 8 is a top view of the standby tray and processing tray of the sheet post-processing apparatus according to the embodiment of the present invention.

As shown in FIGS. 7 and 8, the standby tray 10 has a pair of tray members 10*a* and 10*b*. The tray members 10*a* and 10*b* receive the sheets P in a state that the members slide in the width of the sheet P and support both sides of the sheet P. On the tray members 10*a* and 10*b*, standby stoppers 10*c* and 10*d* for restricting the rear ends of the sheets P are installed.

Figure 9:
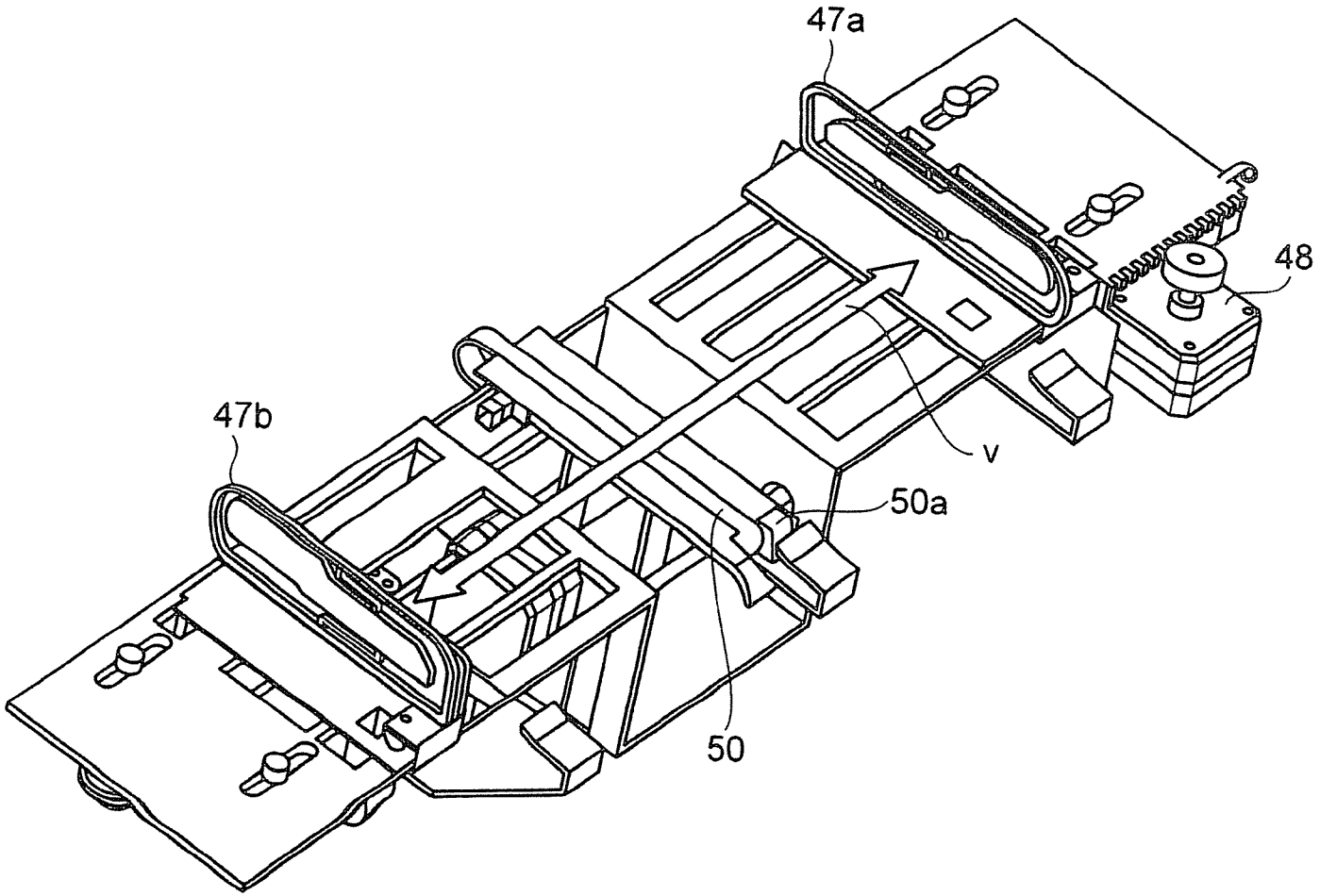
FIG. 9 is a perspective view schematically showing horizontal alignment plates and a conveyer belt of the sheet post-processing apparatus according to the embodiment of the present invention.

The standby tray 10 slides and moves by the motor 34 (refer to FIG. 2). Between the standby tray 10 and the processing tray 12, horizontal alignment plates 47*a* and 47*b* shown in FIG. 9 are installed. When the sheets P are dropped and supplied from the standby tray 10 onto the processing tray 12, the horizontal alignment plates 47*a* and 47*b* prevent the sheets P from turning away in the horizontal direction perpendicular to the feeding direction and horizontally align them. The horizontal alignment plates 47*a* and 47*b* are formed slidably in v direction so as to fit to the width of the sheet P by a motor 48 and can change the position where the sheet alignment is achieved.

The motors 26, 32, 34, 40, 42, 46, and 48 that drive the abovementioned mechanisms and the drive sections 49 and 52 are controlled by a control circuit.

Next, the operation of the sheet post-processing apparatus 7 will be described in line with the flow of the sheet. Although the sheet to which post-processing has been applied can be discharged onto the first or second sheet discharge trays 16 or 18, it is assumed hereinafter that the sheet is discharged onto the first sheet discharge tray 16 for the sake of simplification.

Firstly, a case where the post-processing is not to be performed will be described. When the sheet P on which an image has been formed in the image forming apparatus 5 is supplied by the sheet discharge roller 6, the first sheet discharge tray 16 slides and moves to the position indicated by a dotted line shown in FIG. 3 and can load the sheets P discharged from the standby tray 10 in a good alignment state.

In this case, the gate G is positioned at the first position, and the sheet P fed from the entrance rollers 22 through the paper path ceiling 36 is fed toward the standby tray 10 by the sheet feed rollers 24. The sheet P is then dropped down onto the standby tray 10, fed by the rotating rollers 28 rotated in the direction of the arrow f, and is discharged onto the sheet discharge tray 16.

Next, a case where the post-processing (stapling processing) is to be performed and no preceding sheets P in execution of the staple processing remain on the processing tray 12 will be described. The gate G is positioned at the first position, and the standby tray 10 slides and moves the tray members 10*a* and 10*b* respectively in the directions of arrows m and n of FIG. 8 to open the dropping and supplying path of the sheet P. The horizontal alignment plates 47*a* and 47*b*, to align the sheet P dropping from the sheet feed rollers 24 in the horizontal direction, are arranged so that the gap between the horizontal alignment plates 47*a* and 47*b* is made almost equal to the width of the sheet P. By doing this, the sheet P fed by the sheet feed rollers 24, without the feeding being obstructed by the standby tray 10, is dropped and supplied directly onto the processing tray 12.

At the time of dropping and supplying the sheet P, the upper vertical alignment roller 38*a* is shifted upward, and the receiving portion 44*a* of the paddle 44 receives the rear end of the sheet P. Both sides of the sheet P drop in contact with the horizontal alignment plates 47*a* and 47*b* and are aligned in the horizontal direction. Then, the paddle 44 rotates in the direction of the arrow o in FIG. 6, drops the rear end of the sheet P from the receiving portion 44*a*, and beats down it onto the processing tray 12 by the beating portion 44*b*. Furthermore, the paddle 44 feeds the sheet P in the direction of the arrow q by the feeding portion 44*c* and brings the rear end of the sheet P into contact with stopper 45 and thereby the vertical alignment of the sheet P is accomplished.

In this way, the sheet P on which an image has been formed is loaded directly on the processing tray 12 from the sheet feed rollers 24 while sequentially being aligned in the horizontal direction and vertical direction. When the sheets P reach a predetermined number, the stapler 14 staples the sheets P on the processing tray 12 at a desired position and bundles them to form the sheet bundle T. Thereafter, as shown in FIG. 6, the sheet bundle T is then held between the upper vertical alignment roller 38*a* rotated in the direction of the arrow r and the lower vertical alignment roller 38*b* rotated in the direction of the arrow s and is fed toward the sheet discharge tray 16.

When the rear end of the sheet bundle T passes the upper and lower vertical alignment rollers 38*a* and 38*b*, it is hooked by the feed pawl 50*a* of the conveyor belt 50 rotated in the direction of the arrow t in FIG. 5 and is sent to the first sheet discharge tray 16. Thereafter, the sheet bundle T is discharged onto the sheet discharge tray 16 by discharge rollers 38*c*. At this time, the sheet discharge tray 16 has been slid from the position denoted by the dotted line in FIG. 3 to the position denoted by the solid line.

The first sheet discharge tray 16 is arranged in a tilt angle θ2 and therefore the front end of the sheet P is positioned higher than the rear end thereof, so that the sheet P is sequentially loaded on the sheet discharge tray 16 unless the order is disturbed.

Next, a case where the staple processing is to be performed and preceding sheets P in execution of the staple processing remain on the processing tray 12 will be described. At this time, the standby tray 10 slides and moves the tray members 10*a* and 10*b* respectively in the opposite direction of the direction of the arrow m and in the opposite direction of the direction of the arrow n in FIG. 8, and can support the sheet P. The rotating rollers 28 are shifted above the standby tray 10 so as not to disturb the sheets P. The sheets P discharged from the image forming apparatus 5 and fed by the sheet feed rollers 24 are loaded once on the standby tray 10 to wait for the processing tray 12 to be free.

The second and subsequent sheets P loaded on the standby tray 10 are fed to the standby stoppers 10*c* and 10*d* side by the rotating rollers 28 rotated in the opposite direction of the direction of the arrow f in FIG. 3. As a result, the sheets P are vertically aligned with the rear end of the sheets P brought into contact with the standby stoppers 10*c* and 10*d*. Since the standby tray 10 is arranged in a tilt angle θ1 and therefore the front end of the sheet P is positioned higher than the rear end thereof, the sheet P drops by its own weight down to the position where the rear end thereof is brought into contact with the standby stoppers 10*c* and 10*d* and the vertical alignment is accomplished.

During this period, when the preceding sheet P on the processing tray 12 is discharged on the side of the sheet discharge tray 16 and the processing tray 12 becomes free, the standby tray 10 slides and moves the tray members 10*a* and 10*b* respectively in the directions of the arrows m and n in FIG. 8.

By doing this, for example, two sheets P standing by on the standby tray 10 are dropped and supplied onto the processing tray 12 from between the tray members 10*a* and 10*b*. Thereafter, the sheets P dropped from the standby tray 10 are controlled on both sides by the horizontal alignment plates 47*a* and 47*b* and are aligned horizontally. Then, as described in FIG. 6, the sheets P are fed in the direction of the arrow q by the vertical alignment roller 38*b*, and the rear ends thereof are brought into contact with the stopper 45, thereby accomplishing the vertical alignment of the sheets P. In the same manner as described above, the third and subsequent sheets P are directly dropped and supplied onto the processing tray 12 from between the tray members 10*a* and 10*b*. Thereafter, the third and subsequent sheets P are sequentially aligned on the sheets P loaded earlier on the processing tray 12 by the paddle 44.

When the sheets P loaded on the processing tray 12 reach a predetermined number, the sheets P are stapled by the stapler 14 to form a sheet bundle T. Thereafter, the sheet bundle T is fed toward the sheet discharge tray 16 by the upper and lower vertical alignment rollers 38*a* and 38*b*. Further, the rear end of the sheet bundle T is hooked by the feed pawl 50*a* of the conveyor belt 50 and is sent to the sheet discharge tray 16. Thereafter, the sheet bundle T is discharged onto the sheet discharge tray 16 by the discharge rollers 38*c*.

The entire operation of the sheet post-processing apparatus 7 has been described. Next, a configuration of the sheet discharge section for discharging the sheet to the sheet discharge tray 16, which is the feature of the present invention will be described.

As shown in FIG. 3, the sheet discharge section has a sensor 71 near a sheet discharge port 70 of the sheet post-processing apparatus 7. The sensor 71 detects the upper most surface of the sheets discharged onto the sheet discharge tray 16. In response to the detection result of the sensor 71, the sheet discharge section controls the height position of the sheet discharge tray 16. Further, the sheet discharge section detects an input operation made to an operation section 72 provided on the image forming apparatus 5 in order to determine the type of a sheet to be processed.

Figure 10:
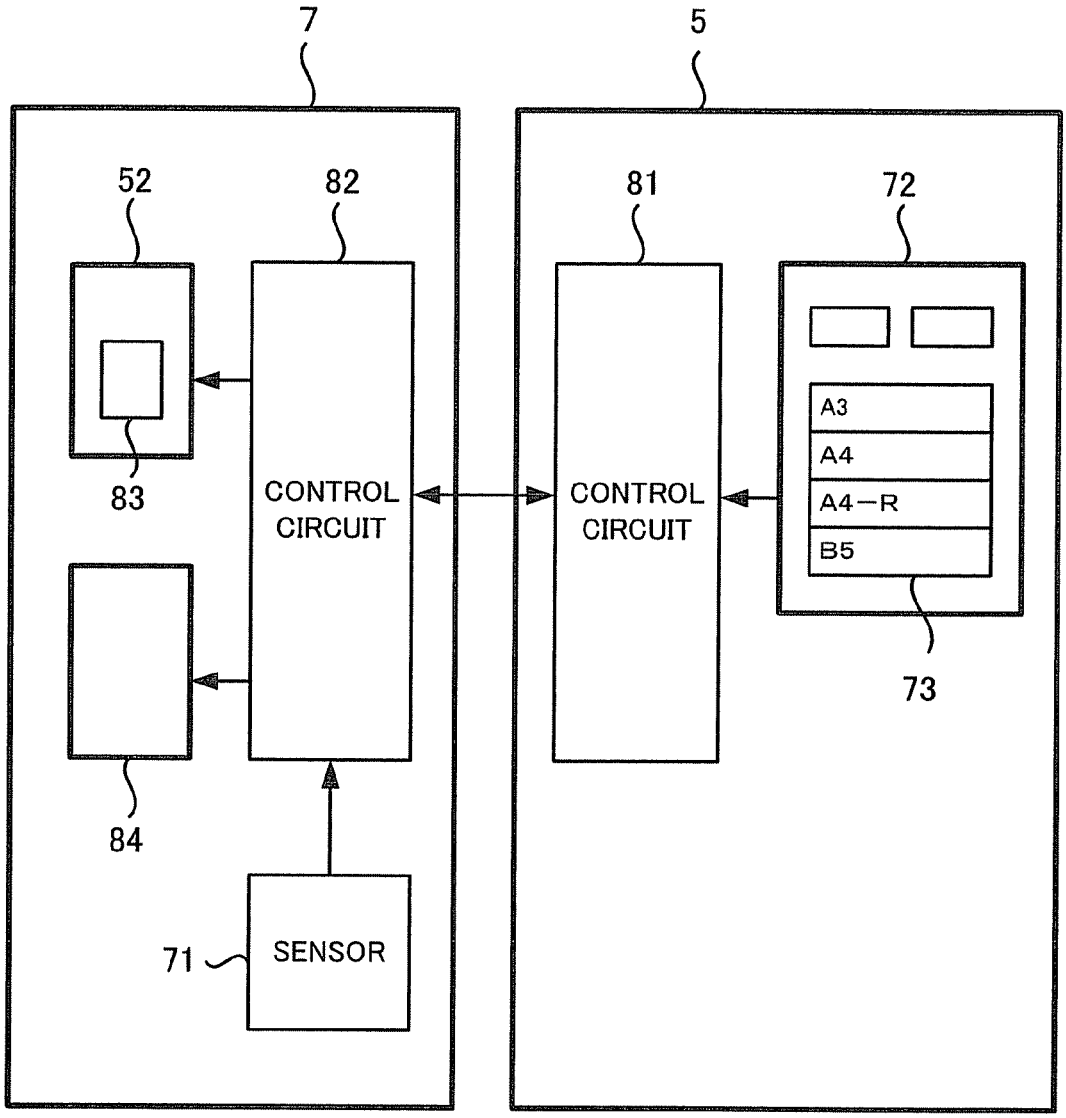
FIG. 10 is a block diagram showing a control system of the sheet post-processing apparatus according to the embodiment of the present invention.

FIG. 10 is a block diagram showing a control system for controlling the sheet discharge section. In FIG. 10, a reference numeral 81 denotes a control circuit that controls the image forming apparatus 5. The control circuit 81 is constituted by a microprocessor including, e.g., a CPU and controls respective sections for completing image forming processing in response to an input made to the operation section 72. The operation section 72 has a selection key 73 for a user to select sheet type and sheet size when he or she performs printing.

A reference numeral 82 denotes a control circuit for controlling the sheet post-processing apparatus 7. The control circuit 82 is constituted by a microprocessor including, e.g., a CPU and communicates with the control circuit 81 of the image forming apparatus 5 so as to allow operations of the image forming apparatus 5 and sheet post-processing apparatus 7 to work together.

The control circuit 82 further controls a drive motor 83 provided in a sheet discharge tray drive section 52 and a drive motor 84 that rotates the conveyer belt 50. To the conveyer belt 50, the feed pawl 50*a* for hooking the rear end of the sheet bundle T is attached. When the conveyer belt 50 is rotated, the feed pawl 50*a* feeds the sheet bundle T to the sheet discharge port 70. To the control circuit 82, a detection result from the sensor 71 is input.

Figure 11:
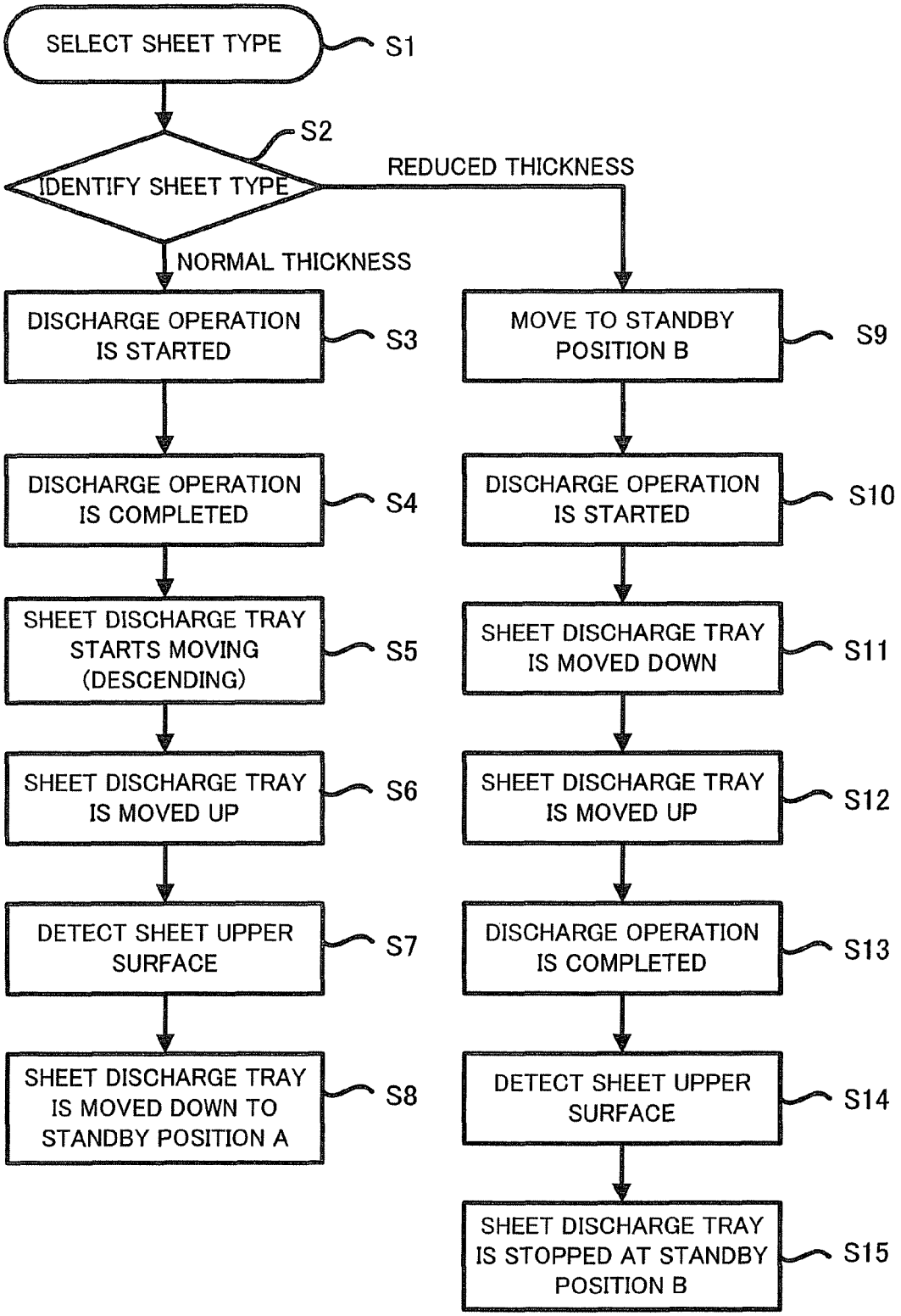
FIG. 11 is a flowchart explaining the operation of a sheet discharge section in the sheet post-processing apparatus according to the embodiment of the present invention.

FIG. 11 is a flowchart for explaining operation of the sheet discharge section performed under control of the control circuits 81 and 82. In step S1 of FIG. 11, when a user operates the operation key 73 to select sheet type for performing printing, the sheet type (sheet thickness in this case) is determined in step S2. It is assumed here that an A4 sheet having a normal thickness or A4 sheet having a reduced thickness is selected and that stapled sheet bundle is discharged.

In the case where the A4 sheet having a normal thickness is selected, the flow then advances to step S3 where discharge operation of the sheet bundle T is started to rotate the conveyer belt 50. Accordingly, the feed pawl 50*a* feeds the sheet bundle T to the discharge port 70, and the sheet discharge operation is completed in step S4. At this time, the sheet discharge tray 16 is positioned at a previously set first height position H1 for receiving the A4 sheet having a normal thickness and then receives the discharged sheet bundle T and stores it.

Subsequently, the sheet discharge tray 16 starts moving to go down once in step S5 and then goes up in step S6. Then, in step S7, the sensor 71 detects the upper surface of the sheet bundle T discharged onto the sheet discharge tray 16, and, in step S8, the sheet discharge tray 16 is moved down such that the upper surface of the sheet bundle T is positioned at the first height position H1. The sheet discharge tray 16 stands by at this position. This standby position is set as A.

In the case where the A4 sheet having a reduced thickness has been detected in step S2, the flow advances to step S9, where the sheet discharge tray 16 is moved up to a second height position H2. The second height position H2 is higher than the first height position H1 and positions immediately below the sensor 71.

In step S10, discharge operation of the sheet bundle T is started to rotate the conveyer belt 50. Accordingly, the feed pawl 50*a* starts feeding the sheet bundle T to the sheet discharge port 70. After that, in step S11, the sheet discharge tray 16 is moved down so that the feed pawl 50*a* does not collide with the sheet discharge tray 16.

Subsequently, in step S12, the sheet discharge tray 16 is moved up once again and receives the discharged sheet bundle T and stores. it. After the discharge operation of the sheet bundle T has been completed in step S13, the sensor 71 detects the upper surface of the sheet bundle T in step S14. Thus, in step S15, the sheet discharge tray 16 is stopped at the position where the upper position of the sheet bundle T is positioned at the second height position H2 and stands by at this position. This standby position is set as B.

Although a case where the sheet bundle T is stored in the sheet discharge tray 16 has been described in this example, the same operation is applied also to a case where the sheet is discharged one by one.

Figure 12A:
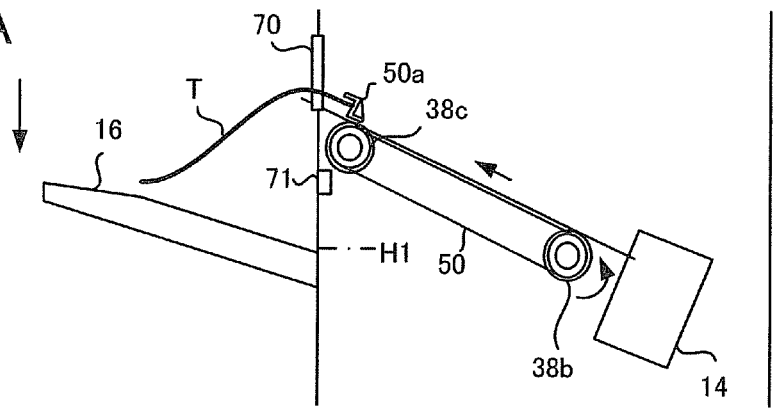
FIGS. 12A to 12C are explanatory views each showing the operation of the sheet discharge section in the sheet post-processing apparatus according to the embodiment of the present invention.
Figure 12B:
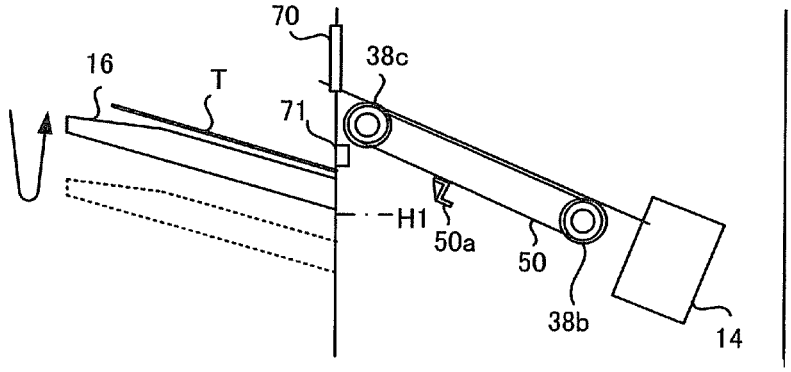
Figure 12C:
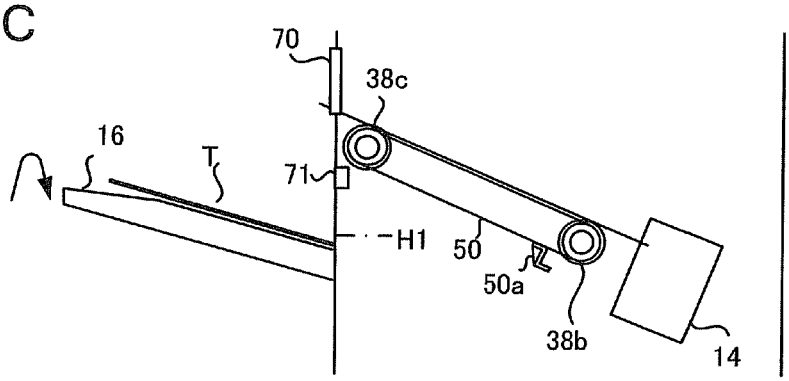
Figure 13A:
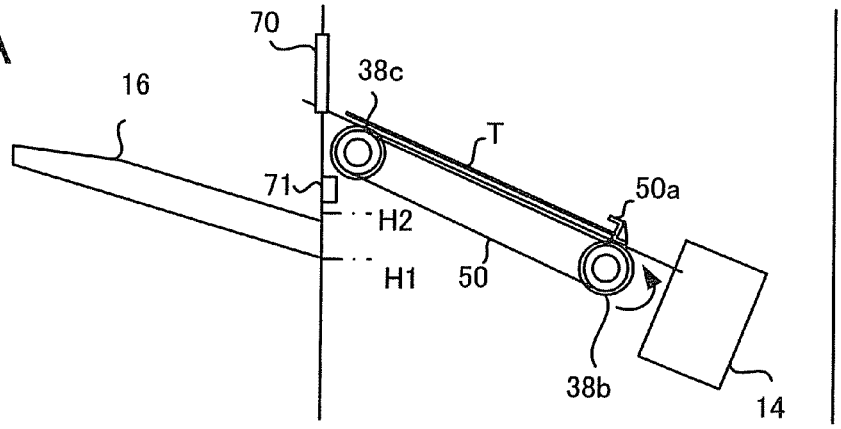
FIGS. 13A to 13C are explanatory views each showing the operation of the sheet discharge section in the sheet post-processing apparatus according to the embodiment of the present invention.
Figure 13B:
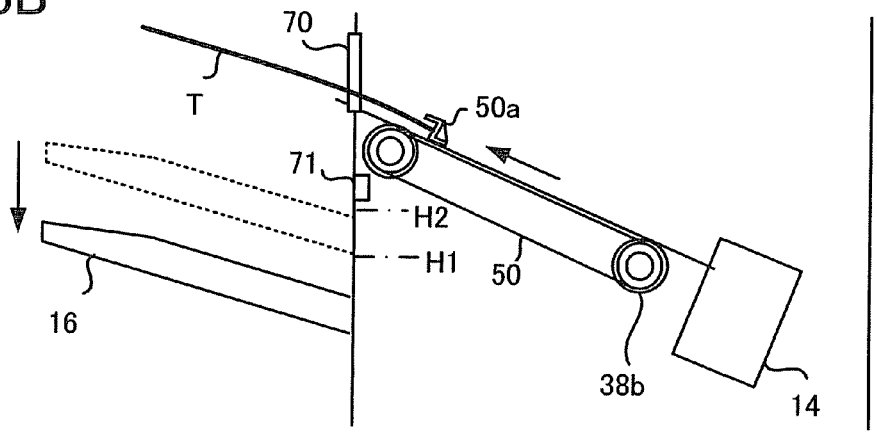
Figure 13C:
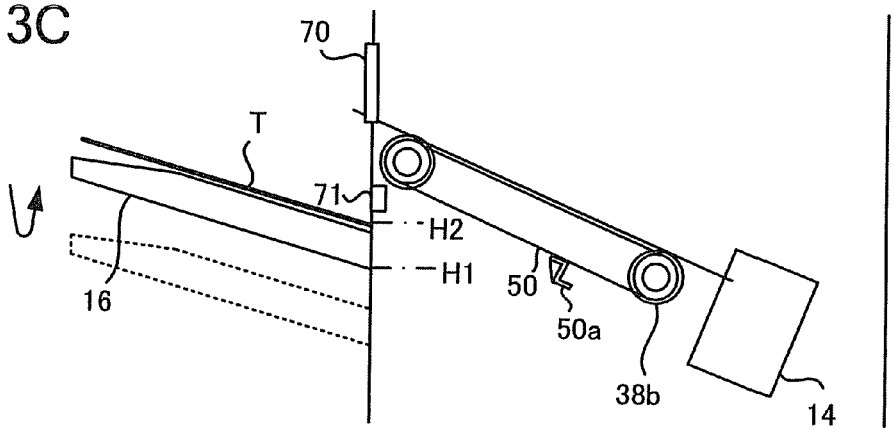

The above operation of the sheet discharge section shown in the flowchart is shown in FIGS. 12A to 12C and FIGS. 13A to 13C. FIGS. 12A to 12C show a case where the A4 sheet having a normal thickness is selected. FIGS. 13A to 13C show a case where the A4 sheet having a reduced thickness is selected.

FIG. 12A, which is the operation from step S2 to step S4, shows a state immediately before the discharge operation of the sheet has been completed. FIG. 12B, which is the operation from step S5 to step S7, shows the operation up to the detection of the sheet upper surface made by the sensor 71. FIG. 12C, which is the operation of step S8, shows a state where the sheet discharge tray 16 stands by at the position where the uppermost surface of the discharged sheet corresponds to the first height position H1. This position is the first standby position.

FIG. 13A, which is the operation from step S9 to step S10, shows a state where the feed pawl 50*a* is moved to start the sheet discharge operation. FIG. 13B, which is the operation of step S11, shows a state where the sheet discharge tray 16 has been moved down. FIG. 13C, which is the operation from step S12 to step S15, shows a state where the upper surface of the sheet is detected by the sensor 71 and the sheet discharge tray 16 stands by at the position where the uppermost surface of the discharged sheet corresponds to the second height position H2. This position is the second standby position.

As shown in FIG. 12C, the A4 sheet having a normal thickness is discharged from the sheet discharge port 70 with comparatively a large height difference onto the sheet discharge tray 16. This positional relationship is a normal state, and the sheet discharge tray 16 is moved down as the thickness of the sheet to be loaded increases. The discharged sheets are sequentially loaded up to the height position H1.

As described above, the A4 sheet having a normal thickness has comparatively a large stiffness and therefore difficult to be curled. Since the sheet is difficult to be curled even if it is received at the first standby position H1, the sheets P loaded on the sheet discharge tray 16 are less disturbed.

Also in the case where a sheet having a larger size in the sheet discharge direction, such as an A4-R, A3, or LT-R size sheet is to be processed, the sheet may be received at the first standby position H1. Such a sheet has a large length and the front end of the discharged sheet reaches the surface of the sheet discharge tray 16 before it is curled (refer to FIG. 12A). Thus, the curl of the sheet hardly occurs.

On the other hand, as shown in FIG. 13C, the A4 sheet having a reduced thickness is discharged from the sheet discharge port 70 with a small height difference onto the sheet discharge tray 16. The reduced thickness sheet is easier to be curled at the front end thereof as compared to the sheet having a normal thickness. Therefore, the reduced thickness sheet becomes much easier to be curled in the case where it is received at the first height position H1. However, when the sheet is received at the second height position H2 which means that the sheet is discharged in a near-linear state onto the sheet discharge tray 16, it is possible to prevent the sheet from being curled.

The sheet curling characteristics are determined not only depending on the sheet thickness but also sheet quality. For example, an LT (letter) size sheet which is commonly used in United States is easy to be curled. Therefore, when the LT has been selected on the operation section 72, it is determined that the sheet easy to be curled has been selected, and the sheet is received at the second height position H2, thereby reducing the curl of the sheet. Further, sheet alignment performance on the sheet discharge tray 16 can be enhanced.

Further, a small-size sheet, such as a B5 sheet is easy to be curled. Therefore, in the case where the small-size sheet is to be processed, the sheet should be received at the second standby position H2.

Although the sheet type is determined based on the operation made to the operation section 72 in the above embodiment, in the case where the image forming apparatus 5 and a PC (Personal Computer) are connected to each other through a network and the image forming apparatus 5 is used to print a document or the like created on the PC, a configuration may be adopted in which the specification state of the sheet from the PC is sent to the image forming apparatus 5 and, based on it, the sheet type is determined.

As described above, according to the present invention, the position of the sheet discharge tray is controlled depending on the sheet type when the sheet is discharged onto the sheet discharge tray and thereby it is possible to provide a sheet post-processing apparatus capable of preventing the sheet from being curled, preventing the sheets loaded on the sheet discharge tray from being disturbed, and achieving good sheet alignment performance.

The present invention is not limited to the above embodiment and various modifications are possible within the scope of the invention. For example, the post-processing is not limited to the staple processing, but may be other processing such as hole-punching processing in sheets.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alternations should therefore be seen as within the scope of the present invention.

What is claimed is:

1. A sheet processing apparatus, comprising:

a post-processing section that performs post-processing for a sheet supplied from an image forming apparatus;

a sheet discharge roller that feeds the sheet to which post-processing has been applied by the post-processing section to a sheet discharge port;

a movable sheet discharge tray stores the sheet discharged from the sheet discharge port;

a drive motor moves the sheet discharge tray so that the sheet discharge tray receives the sheet discharged from the sheet discharge port at a first standby position or at a second standby position higher than the first standby position; and a controller that controls the height position of the sheet discharge tray based on the sheet identification, the controller changes the height position of the sheet discharge tray to the first standby position if the sheet is a first type while to the second standby position if the sheet is a second type.

2. The sheet processing apparatus according to claim 1, wherein the controller changes the height position of the sheet discharge tray such that the uppermost surface of the sheet stored in the sheet discharge tray corresponds to the first standby position if the sheet is the first type while the uppermost surface of the sheet stored in the sheet discharge tray corresponds to the second standby position if the sheet is the second type.

3. The sheet processing apparatus according to claim 2, wherein the type of the sheet is determined based on the size of the sheet, and the controller changes the height position of the sheet discharge tray depending on the sheet type to allow the sheet discharge tray to receive the sheet at the first standby position if the size of the sheet is larger than a predetermined size, while to receive the sheet at the second standby position if the size of the sheet is smaller than a predetermined size.

4. The sheet processing apparatus according to claim 2, wherein the type of the sheet is determined based on the quality or thickness of the sheet, and the controller changes the height position of the sheet discharge tray depending on the sheet type to allow the sheet discharge tray to receive the sheet at the first standby position if the stiffness of the sheet is larger than a predetermined value while to receive the sheet at the second standby position if the stiffness of the sheet is smaller than a predetermined value.

5. The sheet processing apparatus according to claim 1, wherein an operation section for allowing a user to select the sheet type is provided on the image forming apparatus, and the controller identifies the sheet type based on the selection result.

6. The sheet processing apparatus according to claim 1, further comprising:

a sensor to detect an uppermost surface of the sheet stored in the sheet discharge tray is attached near the sheet discharge port, wherein the controller moves down the sheet discharge tray to a position lower than the first standby position along with the sheet discharge operation performed by a feeding means device, then, moves up the sheet discharge tray, and, based on the sensor detection result, stops the sheet discharge tray at the first standby position if the sheet is a first type while stops the sheet discharge tray at the second standby position if the sheet is a second type.

7. A sheet processing method, comprising:

post-processing for a sheet supplied from an image forming apparatus by a post processing section;

feeding the sheet to which post-processing has been applied by the post-processing section to a sheet discharge tray via a sheet discharge port;

identifying the type of the sheet supplied from the image forming apparatus;

moving the sheet discharge tray so that the sheet discharge tray receives the sheet discharged from the sheet discharge port at a first standby position or at a second standby position higher than the first standby position by a drive motor; and changing the height position of the sheet discharge tray based on the sheet identification to the first standby position if the sheet is a first type while to the second standby position if the sheet is a second type.

8. The sheet processing method according to claim 7, wherein the height position of the sheet discharge tray is changed based on the identification result of the sheet type to receive the sheet at the first standby position if the size of the sheet in the discharge direction is larger than a predetermined size, while to receive the sheet at the second standby position if the size of the sheet in the discharge direction is smaller than a predetermined size.

9. The sheet processing method according to claim 7, wherein the height position of the sheet discharge tray is changed based on the identification result of the sheet type to receive the sheet at the first standby position if the stiffness of the sheet is larger than a predetermined value, while to receive the sheet at the second standby position if the stiffness of the sheet is smaller than a predetermined value.

10. The sheet processing method according to claim 7, wherein detecting an uppermost surface of the sheet stored in the sheet discharge tray using a sensor attached near the sheet discharge port, when the height position of the sheet discharge tray is changed, the sheet discharge tray is moved down to a position lower than the first standby position along with a sheet discharge operation and then is moved up, and based on a detection result of the sensor, the sheet discharge tray is stopped at the first standby position if the sheet is the first type, while the sheet discharge tray is stopped at the second standby position if the sheet is the second type.

* * * * *